US006129247A

United States Patent [19]

Thomas et al.

[11] Patent Number: 6,129,247

[45] Date of Patent: Oct. 10, 2000

[54] SEAL ARRANGEMENTS FOR PRESSURIZED DISPENSING CONTAINERS

[75] Inventors: Jonathan Thomas, King's Lynn; Richard John Warby, Wisbech, both of United Kingdom

[73] Assignee: Bespak plc, United Kingdom

[21] Appl. No.: 09/077,027

[22] PCT Filed: Nov. 14, 1996

[86] PCT No.: PCT/GB96/02793

§ 371 Date: May 18, 1998

§ 102(e) Date: May 18, 1998

[87] PCT Pub. No.: WO97/18146

PCT Pub. Date: May 22, 1997

[30] Foreign Application Priority Data

Nov. 16, 1995 [GB] United Kingdom ..... 9523457

[51] Int. Cl.[7] ..... B65D 83/00

[52] U.S. Cl. ..... 222/402.24; 222/402.1; 222/402.25; 222/635

[58] Field of Search ..... 222/635, 402.1, 222/402.24, 402.25

[56] References Cited

U.S. PATENT DOCUMENTS

| | | | |
|---|---|---|---|
| 4,271,875 | 6/1981 | Meshberg | 141/3 |
| 4,396,152 | 8/1983 | Abplanalp | 222/402.24 |
| 5,037,012 | 8/1991 | Langford | 222/402.2 |
| 5,775,321 | 7/1998 | Alband | 222/402.1 |

FOREIGN PATENT DOCUMENTS

| | | | |
|---|---|---|---|
| 0281730A2 | 9/1988 | European Pat. Off. . | |
| 1562597 | 4/1969 | France . | |
| 848998 | 11/1956 | United Kingdom . | |
| 2212222 | 7/1989 | United Kingdom | 222/402.24 |
| 0000582 | 8/1979 | WIPO | 222/492.24 |
| 9425373 | 11/1994 | WIPO . | |
| 9503985 | 2/1995 | WIPO . | |

*Primary Examiner*—Joseph A. Kaufman
*Attorney, Agent, or Firm*—Smith, Gambrell & Russell, LLP

[57] ABSTRACT

A pressurized dispensing apparatus includes a container for product to be dispensed and a valve for controlling outflow of product from the container. The valve includes a valve body (12) located within the container. The container includes an open ended container body (16) and a closure (15) fixedly attached to the container body for closing the open end thereof. The closure has an annular sidewall extending around at least the upper end of the container body. A first seal (20) is located in sealing engagement between the container body and the closure, and a second seal (25) is located in sealing engagement between the valve body and the container.

11 Claims, 6 Drawing Sheets

SEAL ARRANGEMENTS FOR PRESSURIZED DISPENSING CONTAINERS

The invention relates to pressurized dispensing containers with an improved seal arrangement.

BACKGROUND ART

Pressurized dispensing containers are used for dispensing a wide variety of products from mobile to viscous liquid products, powdered products and the like and typically employ a liquid propellant such as a hydrocarbon or fluocarbon having sufficiently high vapor pressure at normal working temperatures to propel the product through the dispensing apparatus. These are commonly used for dispensing pharmaceuticals and medicaments.

Generally such pressurized dispensing containers comprise a container, a dispensing valve and a closure which is crimped to the container to hold the valve in place. A seal, usually made of an elastomeric material, is compressed between the container and the closure to prevent leakage. The efficiency of the sealing arrangement is particularly important to prevent the leakage of propellants. It is important that leakage is minimized, despite the latest propellants being more environmentally friendly than predecessors, to prevent the loss of the container contents, ensuring that there are sufficient contents available after storage to meet the claims of the packaging and also to ensure that the ratio of propellant to product remains constant.

It has hitherto been a problem that the deformation of the seal during the crimping operation can lead to a reduction in the effectiveness of the seal. During the crimping operation, the seal may also be deformed in a manner which does not provide a true seal.

Also it has hitherto been a problem that the permeability of the seal material with respect to the propellants has led to loss of propellant during storage of the container and during the shelf-life of the product.

To overcome such problems it has been proposed to use two seals, both of which are sandwiched between the container and the closure. An example of such proposal is described in International patent specification WO94/25373 in which is disclosed a pressurized dispensing container comprising valve means, a valve body, an open ended container body, a closure, a first seal between the container body and the closure and a second seal between the valve body and the container, said seals being independent such that the second seal seals off the container body from the first seal.

It is an object of the present invention to provide a further improved sealing arrangement for pressurized dispensing containers.

SUMMARY OF THE INVENTION

According to the invention there is therefore provided pressurized dispensing apparatus comprising a container for product to be dispensed, valve means for controlling outflow of product from the container, said valve including a valve body located within the container, said container comprising an open ended container body and a closure fixedly attached to said container body for closing the open end thereof, said closure having an annular sidewall extending around at least an upper end of the container body, said apparatus further comprising a first seal located in sealing engagement between the container body and the closure and a second seal located in sealing engagement between the valve body and the container, the first and second seals comprising independent seal members positioned such that the second seal seals off the container body from the first seal, characterized in that the first seal is also in sealing engagement with the valve body.

BRIEF DESCRIPTION OF THE DRAWINGS

A preferred embodiment of the present invention will now be described, by way of example only, with reference to the accompanying drawings in which.

DETAILED DESCRIPTION OF A PREFERRED EMBODIMENT

Figure 1:
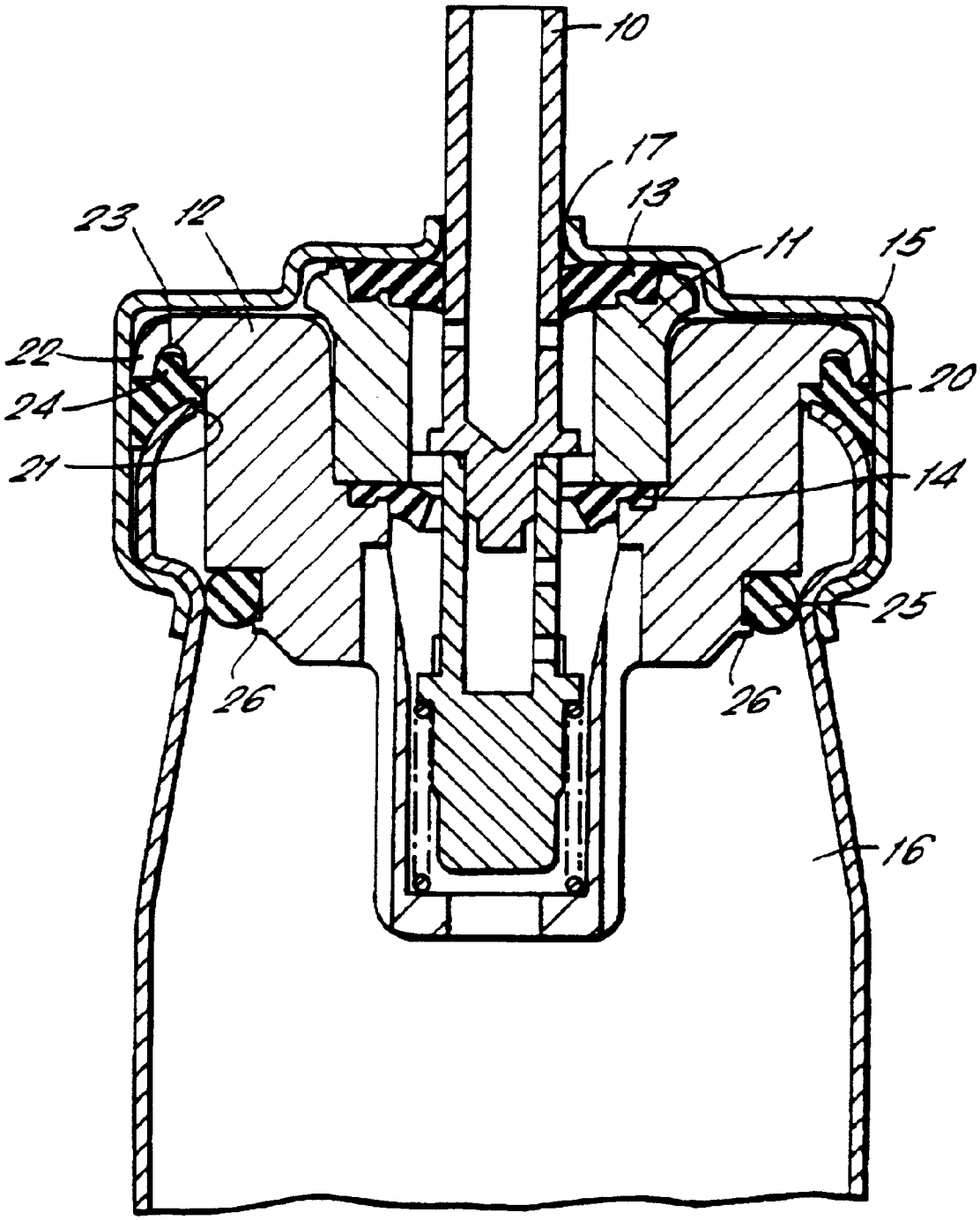
FIGS. 1 and 2 illustrate a metering valve known in the prior art for use in a pressurizing dispensing container incorporating alternative seal arrangements according to the present invention.
Figure 2:
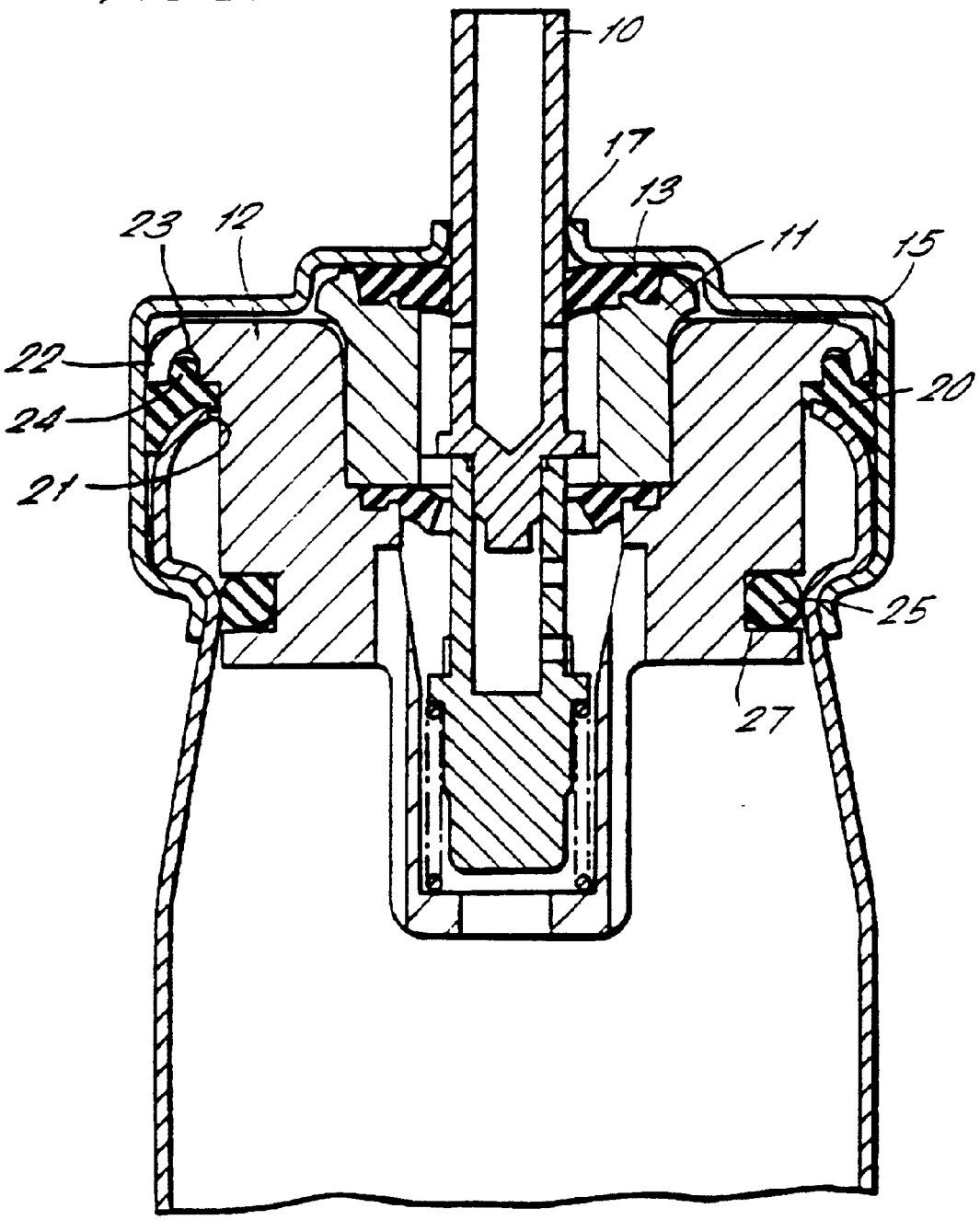
Figure 3:
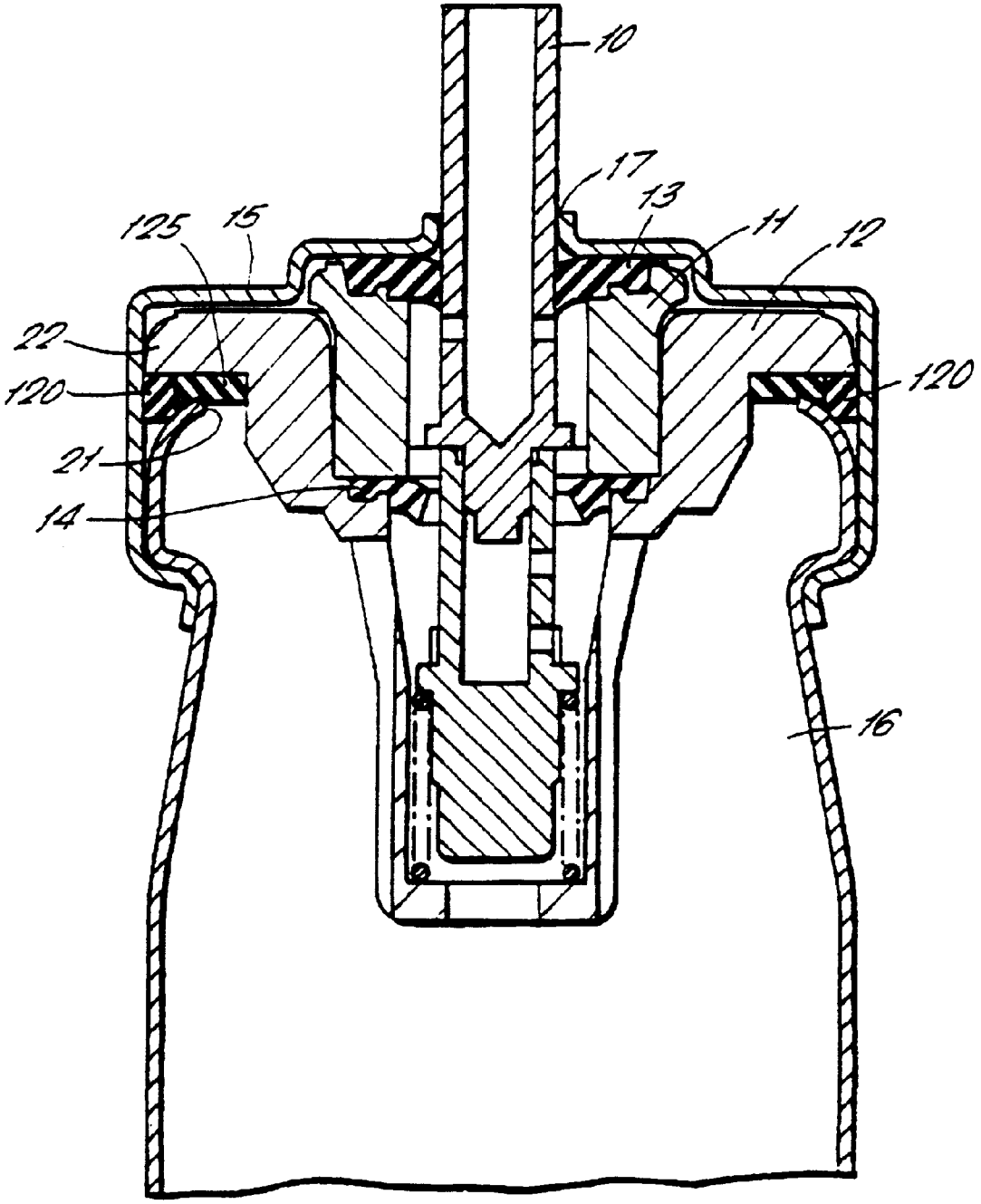
Figure 4:
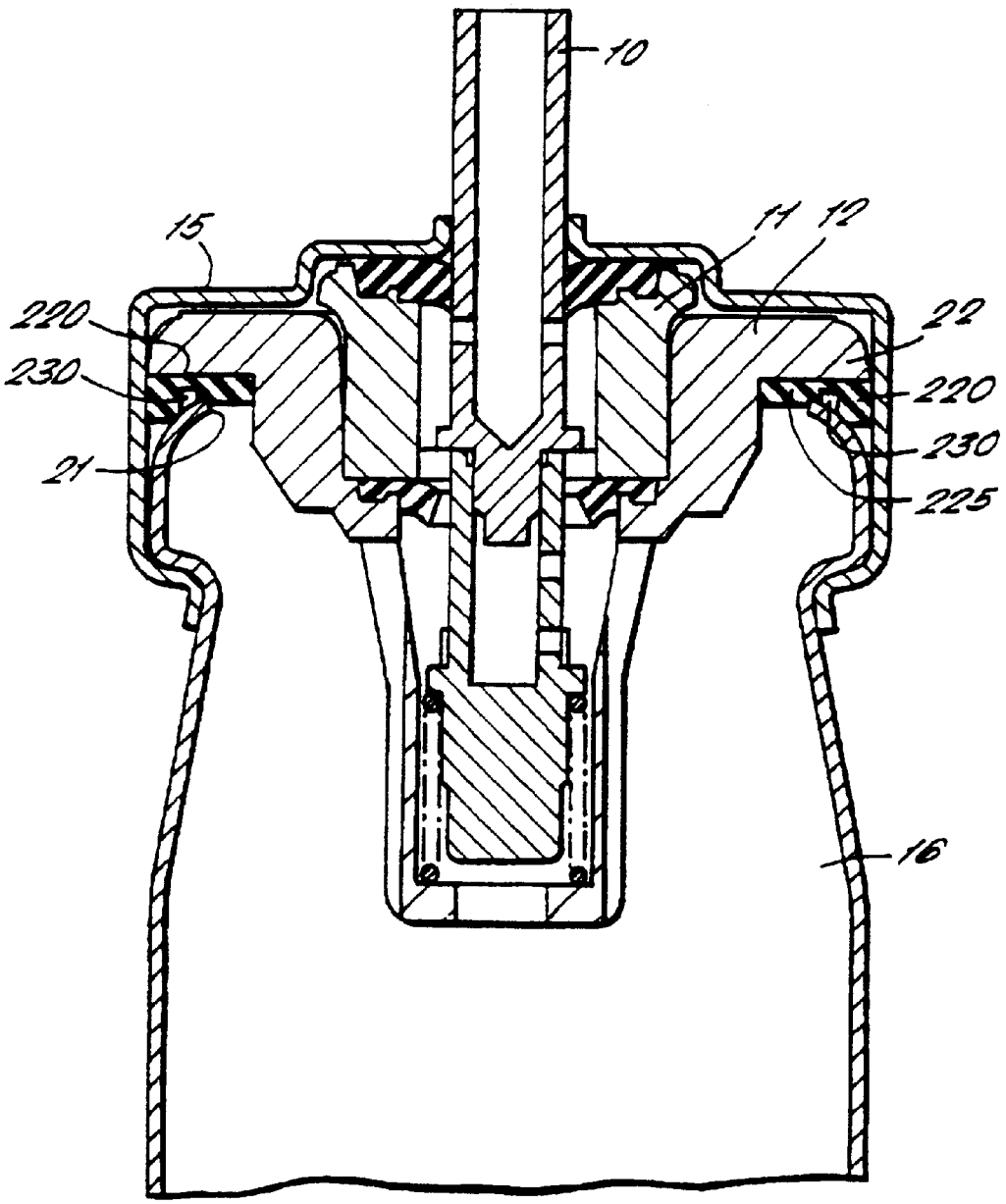
Figure 5:
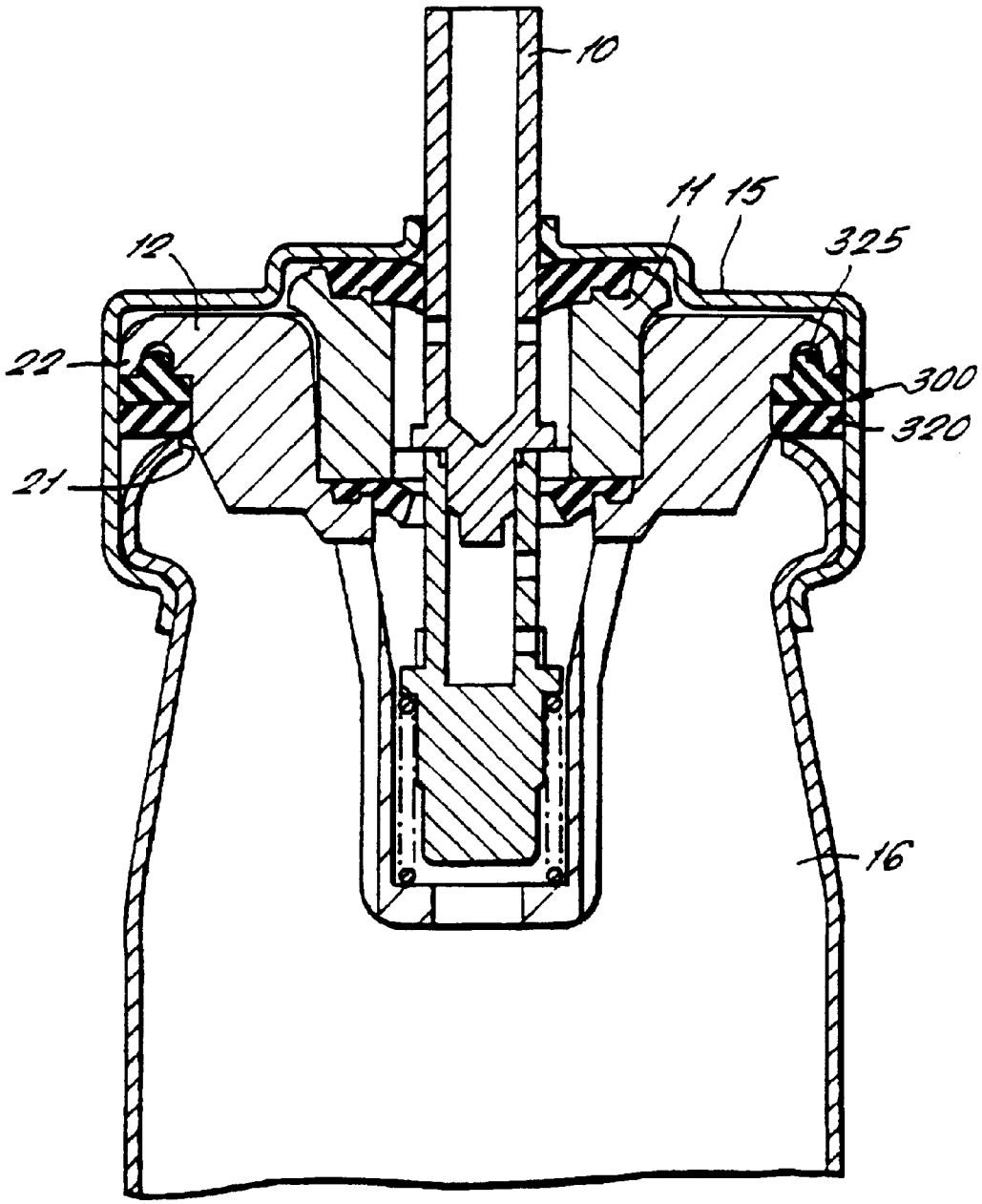
Figure 6:
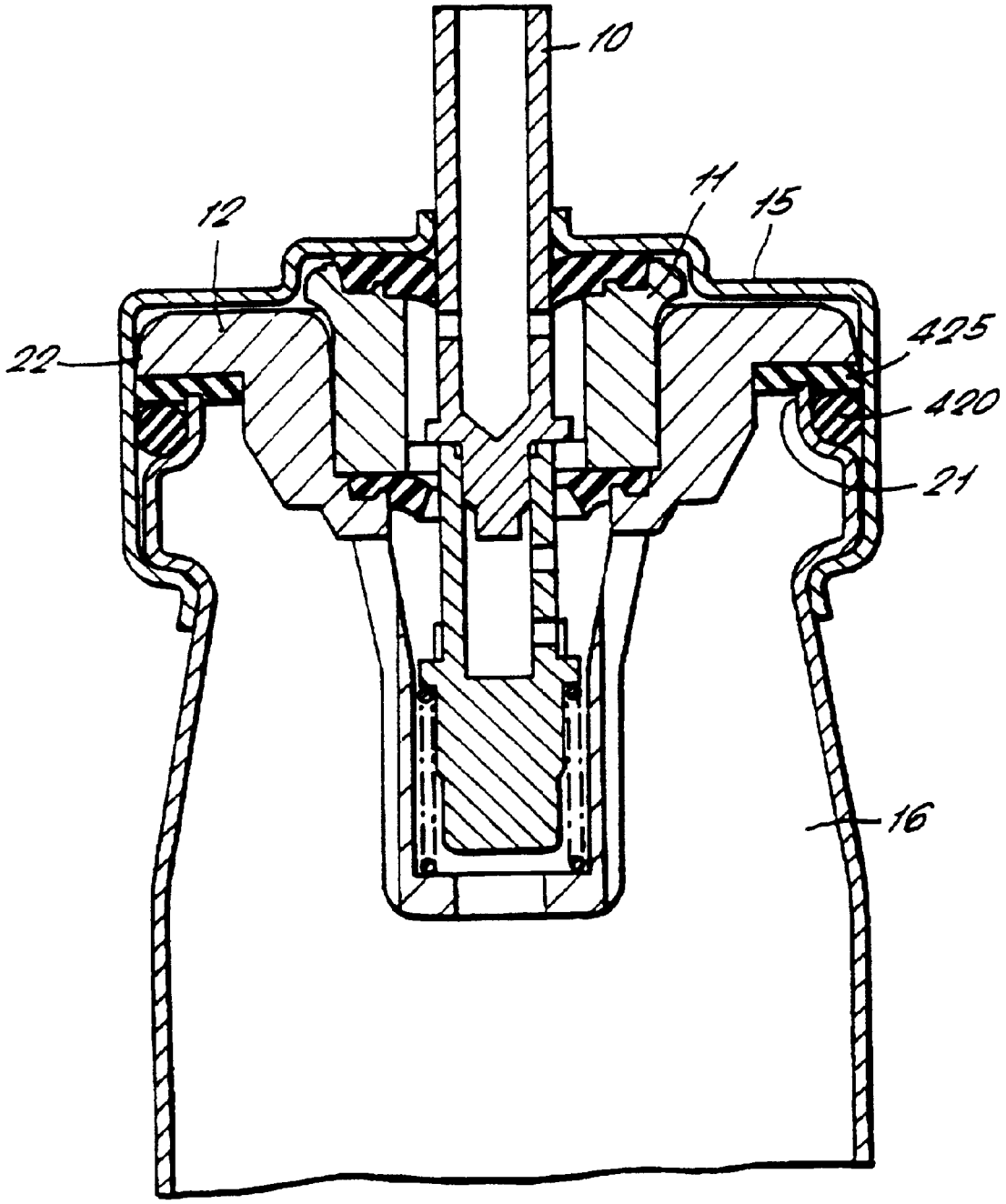

Referring to FIGS. 1 and 2 a metering valve comprises a valve member 10 in the form of a valve stem which is axially slidable within an annular metering chamber 11. The metering chamber 11 and a portion of the valve member 10 are located within a valve body 12. An outer seal 13 and an inner seal 14 extend radially between the valve member 10 and the chamber 11. The outer seal 13 is sandwiched between an upper end of the metering chamber 11 and a closure or ferrule 15 which is crimped to a container body 16 covering an open end therefore, thus providing a closed container holding the product to be dispensed. The closure 15 has a central aperture 17 through which the valve member 10 extends. Depression of the valve member 10 causes the product to exit the container 16 from the chamber 11 through a passageway in the valve member 10. The form and operation of the metering valve may be selected as required.

The first seal 20 of the seal arrangement of the present invention is located between an external surface of the upper end of the container body 16 and an inner surface of an annular sidewall of the closure 15. In the embodiments of the invention shown in FIGS. 1 and 2, the first seal 20 is provided by a gasket in sealing engagement with the rim forming the annular opening 21 of the container body 16. The first seal 20 is further in sealing engagement with a flanged section 22 of the valve body 12. In FIGS. 1 and 2 this flanged section also has an annular groove 23 which receives an annular ring 24 projecting from the first seal 20. This groove and ring arrangement 23, 24 is optional, and helps to locate and hold the first seal 20 in position relative to the valve body 12, especially during the fitting and crimping operations.

A second seal 25, shown in FIGS. 1 and 2 as an O-ring, is provided in sealing engagement with an internal surface of the container body 16, preferably at a neck portion thereof, and the valve body 12. The second seal 25 may be retained by retention nodules 26 as illustrated in FIG. 1 or within an annular groove 27 in the valve body 12 as illustrated in FIG. 2.

The second seal 25 thus seals off the main body of the container body 16 from the first seal 20. This relieves the pressure on the first seal 20. Thus if that seal is weakened during the crimping operation, the integrity of the overall seal will be less effected. Furthermore, the second seal 25 limits the quantity of propellant or product which can reach the first seal 20. Thus if there is a problem in the efficiency of that seal, again a quantity of leakage can be reduced significantly. As the second seal 25 is not in contact with the closure 15, it is unaffected by the crimping operation. This provides extra security in the event that the first seal 20 is damaged in the crimping operation.

The first and second seals can be made from any appropriated material, including elastomers, rubbers (including nitrile rubbers), thermoplastics and so on. If the dispensing container is used for medicinal or pharmaceutical formulations, than an appropriate seal material must be selected which does not contaminate the product.

Preferably the second seal is made of an ethylene-propylene-diene rubber ("EPDM"). Optimally the first seal is also an EPDM gasket seal. Dispensing apparatus according to the present invention with seals from such materials, are of particular use when propellants such as HFC-134a or HFC-227 are involved and varying levels of ethanol.

What is claimed is:

1. Pressurized dispensing apparatus comprising a container for product to be dispensed, valve means for controlling outflow of product from the container, said valve including a valve body (12) located within the container, said container comprising an open ended container body (16) and a closure (15) fixedly attached to said container body (16) for closing the open end thereof, said closure (15) having an annular sidewall extending around at least an upper end of the container body (16), said apparatus further comprising a first seal (20) located in sealing engagement between the container body (16) and the closure (15) and a second seal (25) located in sealing engagement between the valve body (12) and the container, the first and second seals (20, 25) comprising independent seal members positioned such that the second seal (25) seals off the container body (16) from the first seal (20), characterized in that the first seal (20) is also in sealing engagement with the valve body (12).

2. Pressurized dispensing apparatus as claimed in claim 1 in which the second seal (25) is located in sealing engagement between the valve body (12) and the container body (16).

3. Pressurized dispensing apparatus as claimed in claim 2 in which at least one of the seals (20, 25) is an O-ring.

4. Pressurized dispensing apparatus as claimed in claim 2 in which the second seal (25) is located in an annular groove (27) in an external surface of the valve body (12).

5. Pressurized dispensing apparatus as claimed in claim 1 in which at least one of the seals (20, 25) is an O-ring.

6. Pressurized dispensing apparatus as claimed in claim 1 in which the second seal (25) is located in an annular groove (27) in an external surface of the valve body (12).

7. Pressurized dispensing apparatus as claimed in claim 1 in which the second seal (25) is held in position on the valve body (16) by means of locating nodules (26).

8. Pressurized dispensing apparatus as claimed in claim 1 in which the valve body (16) has a radially extended flange (22) extending between a main body portion and the sidewall of the closure (15).

9. Pressurized dispensing apparatus as claimed in claim 8 in which a transverse face of the flange (22) provides a seat for engagement with at least one of the seals (20, 25).

10. Pressurized dispensing apparatus as claimed in claim 9 in which an annular groove (23) is provided in the transverse face of the flange (22) for receiving a corresponding projection (24) on at least one of the seals in contact therewith.

11. Pressurized dispensing apparatus as claimed in claim 8 in which the flange (22) provides a further seal between the valve body (16) and the closure (15).

* * * * *